US007995943B2

(12) United States Patent
Kouno et al.

(10) Patent No.: US 7,995,943 B2
(45) Date of Patent: Aug. 9, 2011

(54) ELECTROPHOTOGRAPHIC IMAGE FORMING APPARATUS FOR USE WITH POWDER DEVELOPER MATERIAL

(75) Inventors: Ryouji Kouno, Aichi-ken (JP); Hiroshi Goto, Aichi-ken (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 511 days.

(21) Appl. No.: 12/137,968

(22) Filed: Jun. 12, 2008

(65) Prior Publication Data

US 2008/0310871 A1 Dec. 18, 2008

(30) Foreign Application Priority Data

Jun. 13, 2007 (JP) ..... 2007-156772

(51) Int. Cl.
*G03G 15/09* (2006.01)
*G03G 15/08* (2006.01)
*G03G 15/06* (2006.01)

(52) U.S. Cl. ..... 399/55; 399/270; 399/285

(58) Field of Classification Search ..... 399/53, 399/55, 56, 270, 285
See application file for complete search history.

(56) References Cited

U.S. PATENT DOCUMENTS

| | | | | |
|---|---|---|---|---|
| 4,395,476 | A | 7/1983 | Kanbe et al. | |
| 2006/0233572 | A1* | 10/2006 | Ogawa et al. | 399/270 |
| 2007/0098461 | A1* | 5/2007 | Miyabe et al. | 399/285 |
| 2008/0124138 | A1* | 5/2008 | Kosugi et al. | 399/285 |

FOREIGN PATENT DOCUMENTS

| | | | |
|---|---|---|---|
| JP | 55-18658 | A | 2/1980 |
| JP | 58-37657 | A | 3/1983 |
| JP | 4-136959 | A | 5/1992 |
| JP | 5-11582 | A | 1/1993 |
| JP | 6-242657 | A | 9/1994 |
| JP | 2001-356597 | A | 12/2001 |

OTHER PUBLICATIONS

Notice of Preliminary Rejection with English Translation, Japanese Application No. 2007-156772, dated Jun. 18, 2009.

* cited by examiner

*Primary Examiner* — David M Gray
*Assistant Examiner* — Joseph S Wong
(74) *Attorney, Agent, or Firm* — Buchanan Ingersoll & Rooney PC

(57) ABSTRACT

An image forming apparatus has a pair of spacedly opposed first and second bearing members, in which a powder developer material is moved from the first bearing member to the second bearing member. The apparatus also has an electric field generator. The generator forms an electric field between the first and second bearing members and outputs a first voltage and a second voltage alternately. The first voltage generates, between the first and second bearing members, a first electric field electrically forcing the developer material from the first bearing member toward the second bearing member. The second voltage generates between the first and second bearing members a second electric field electrically forcing the developer material from the second bearing member toward the first bearing member. Durations of the first and second voltages are determined so that the developer material forced out of the first bearing member due to the first electric field is forced back from the second bearing member toward the first bearing member due to the second electric field to impinge the developer material retained on the first bearing member and thereby flick the developer material on the first bearing member away therefrom and the flicked developer material is then forced from the first bearing member toward the second bearing member by the subsequent first electric field.

1 Claim, 17 Drawing Sheets

Fig. 14A

Toner A(Fa=45[nN])

Halftone Image

| Vpp[V] | 10 | 15 | 20 | 25 | 30 | 35 | 40 | 45 | 50 |
|---|---|---|---|---|---|---|---|---|---|
| 1800 | | | | Y | Y | Y | Y | Y | |
| 1700 | | | Y | Y | Y | Y | Y | Y | |
| 1600 | | Y | Y | Y | Y | Y | Y | | |
| 1500 | | Y | Y | Y | Y | Y | | | |

duty [%]

Fig. 14B

Toner A(Fa=45[nN])

Solid Image

| Vpp[V] | 10 | 15 | 20 | 25 | 30 | 35 | 40 | 45 | 50 |
|---|---|---|---|---|---|---|---|---|---|
| 1800 | | | | Y | Y | Y | Y | Y | Y |
| 1700 | | | Y | Y | Y | Y | Y | Y | Y |
| 1600 | | Y | Y | Y | Y | Y | Y | Y | Y |
| 1500 | | Y | Y | Y | Y | Y | Y | Y | Y |

duty [%]

Fig. 14C

Toner A(Fa=45[nN])

Proper Ragen of Image Density

| Vpp[V] | 10 | 15 | 20 | 25 | 30 | 35 | 40 | 45 | 50 |
|---|---|---|---|---|---|---|---|---|---|
| 1800 | | | | Y | Y | Y | Y | Y | |
| 1700 | | | Y | Y | Y | Y | Y | Y | |
| 1600 | | Y | Y | Y | Y | Y | Y | | |
| 1500 | | Y | Y | Y | Y | Y | | | |

duty [%]

Fig. 15A

Tone B(Fa=30[nN])

Halftoner Image

| Vpp[V] | 10 | 15 | 20 | 25 | 30 | 35 | 40 | 45 | 50 |
|---|---|---|---|---|---|---|---|---|---|
| 1800 | | | | Y | Y | Y | Y | Y | Y |
| 1700 | | | Y | Y | Y | Y | Y | Y | Y |
| 1600 | | Y | Y | Y | Y | Y | Y | Y | |
| 1500 | | Y | Y | Y | Y | Y | Y | | |

duty [%]

Fig. 15B

Toner B(Fa=30[nN])

Solid Image

| Vpp[V] | 10 | 15 | 20 | 25 | 30 | 35 | 40 | 45 | 50 |
|---|---|---|---|---|---|---|---|---|---|
| 1800 | | | | | Y | Y | Y | Y | Y |
| 1700 | | | | Y | Y | Y | Y | Y | Y |
| 1600 | | | Y | Y | Y | Y | Y | Y | Y |
| 1500 | | Y | Y | Y | Y | Y | Y | Y | Y |

duty [%]

Fig. 15C

Toner B(Fa=30[nN])

Proper Range of Image Density

| Vpp[V] | 10 | 15 | 20 | 25 | 30 | 35 | 40 | 45 | 50 |
|---|---|---|---|---|---|---|---|---|---|
| 1800 | | | | | Y | Y | Y | Y | Y |
| 1700 | | | | Y | Y | Y | Y | Y | Y |
| 1600 | | | Y | Y | Y | Y | Y | Y | |
| 1500 | | Y | Y | Y | Y | Y | Y | | |

duty [%]

Fig. 16A

Toner C(Fa=30[nN])

Halftone Image

| Vpp[V] | 10 | 15 | 20 | 25 | 30 | 35 | 40 | 45 | 50 |
|---|---|---|---|---|---|---|---|---|---|
| 1800 | | | | ○ | ○ | ○ | ○ | ○ | ○ |
| 1700 | | | ○ | ○ | ○ | ○ | ○ | ○ | ○ |
| 1600 | | ○ | ○ | ○ | ○ | ○ | ○ | ○ | |
| 1500 | | ○ | ○ | ○ | ○ | ○ | ○ | | |

duty [%]

Fig. 16B

Toner C(Fa=30[nN])

Solid Image

| Vpp[V] | 10 | 15 | 20 | 25 | 30 | 35 | 40 | 45 | 50 |
|---|---|---|---|---|---|---|---|---|---|
| 1800 | | | | | ○ | ○ | ○ | ○ | ○ |
| 1700 | | | | ○ | ○ | ○ | ○ | ○ | ○ |
| 1600 | | | ○ | ○ | ○ | ○ | ○ | ○ | ○ |
| 1500 | | ○ | ○ | ○ | ○ | ○ | ○ | ○ | ○ |

duty [%]

Fig. 16C

Toner C(Fa=30[nN])

Proper Range of Image Density

| Vpp[V] | 10 | 15 | 20 | 25 | 30 | 35 | 40 | 45 | 50 |
|---|---|---|---|---|---|---|---|---|---|
| 1800 | | | | | ○ | ○ | ○ | ○ | ○ |
| 1700 | | | | ○ | ○ | ○ | ○ | ○ | ○ |
| 1600 | | | ○ | ○ | ○ | ○ | ○ | ○ | |
| 1500 | | ○ | ○ | ○ | ○ | ○ | ○ | | |

duty [%]

Fig. 17A

Toner D(Fa=39[nN])

Halftone Image

| Vpp[V] | 10 | 15 | 20 | 25 | 30 | 35 | 40 | 45 | 50 |
|---|---|---|---|---|---|---|---|---|---|
| 1800 | | | | ○ | ○ | ○ | ○ | ○ | ○ |
| 1700 | | | ○ | ○ | ○ | ○ | ○ | ○ | |
| 1600 | | | ○ | ○ | ○ | ○ | ○ | | |
| 1500 | | | ○ | ○ | ○ | ○ | | | |

duty [%]

Fig. 17B

Toner D(Fa=39[nN])

Solid Image

| Vpp[V] | 10 | 15 | 20 | 25 | 30 | 35 | 40 | 45 | 50 |
|---|---|---|---|---|---|---|---|---|---|
| 1800 | | | | | ○ | ○ | ○ | ○ | ○ |
| 1700 | | | | ○ | ○ | ○ | ○ | ○ | ○ |
| 1600 | | | ○ | ○ | ○ | ○ | ○ | ○ | ○ |
| 1500 | | ○ | ○ | ○ | ○ | ○ | ○ | ○ | |

duty [%]

Fig. 17C

Toner D(Fa=39[nN])

Proper Range of Image Density

| Vpp[V] | 10 | 15 | 20 | 25 | 30 | 35 | 40 | 45 | 50 |
|---|---|---|---|---|---|---|---|---|---|
| 1800 | | | | | ○ | ○ | ○ | ○ | ○ |
| 1700 | | | | ○ | ○ | ○ | ○ | ○ | |
| 1600 | | | ○ | ○ | ○ | ○ | ○ | | |
| 1500 | | | ○ | ○ | ○ | ○ | | | |

duty [%]

ELECTROPHOTOGRAPHIC IMAGE FORMING APPARATUS FOR USE WITH POWDER DEVELOPER MATERIAL

FIELD OF THE INVENTION

The present invention relates to an electrophotographic image-forming apparatus for use with a powder developer material.

BACKGROUND OF THE INVENTION

There has been proposed an electrophotographic image-forming apparatus for use with a developer material mainly made of toner. Typically, the image forming apparatus has an electrostatic latent image bearing member or photosensitive member and a developing roller spacedly opposed to the photosensitive member. The developing roller has a cylindrical peripheral surface for supporting electrically charged toner particles thereon. In an image forming operation, an electrostatic latent image is formed on a peripheral surface of the photosensitive member. The electrostatic latent image includes an image portion which will be visualized and a non-image portion which will not be visualized. The charged toner particles are supplied onto the image portion of the electrostatic latent image due to a voltage difference between the image portion of the electrostatic latent image and the developing roller to visualize the image portion into a toner powder image. The toner powder image is transferred and then fused on a medium such as paper to result in an image product.

JP 05-11582 A discloses another image forming apparatus for use with a single component developer material in which an alternating voltage is applied to the developing roller so as to improve the movability of the toner particles from the developer roller to the photosensitive member.

In the meantime, the photosensitive member and/or the developing roller incorporated in the image forming apparatus can be eccentrically supported. This causes a variation of the gap between the photosensitive member and the developing roller during rotations thereof and thereby a variation of a magnitude of the electric field formed between the photosensitive member and the developing roller. As a result, a developing force which overcomes a adhering force of the toner particles onto the developing roller to jump the toner particles away from the developing roller can vary periodically, causing an unwanted density unevenness in the resultant image. The density unevenness may be reduced to a certain extent by a precise positioning the photosensitive member and the opposing developing roller, which in turn results in a significant cost increase in manufacturing and therefore is impractical.

The inventors of the present application have studied the generation of the density unevenness through experiments in detail. This showed a tendency that the density unevenness appeared more in dot images at a reduced alternating voltage and more in solid images at an elevated alternating voltage.

The reasons behind the fact are considered to be as follows. When compared the solid and dot images, the solid electrostatic latent image has a greater electric field than the dot electrostatic latent image. Therefore, the toner particles on the developing roller are attracted onto the solid electrostatic latent image than the dot electrostatic latent image, so that the dot image tends to suffer from more density unevenness due to the eccentricity of the developing roller under the reduced alternating voltage. Under the elevated alternating voltage, a sufficient amount of toner particles needed for visualization is attracted to both solid and dot electrostatic latent image. However, a part of the toner particles on the solid electrostatic latent image may be deprived therefrom by the enhanced electric field which electrically forces the charged toner particles from the photosensitive member back to the developing roller. Contrarily, the toner particles on the dot electrostatic latent image are maintained on the photosensitive member by an edge effect derived from an electric field generated at the edge portion of the dot electrostatic latent image, so that no visible density unevenness would occur on the resultant dot image.

As described above, the mechanism causing the density unevenness in the solid image differs from that in the dot image. Then, the voltage setting for preventing the density unevenness in the solid image differs from that in the dot image. Therefore, it has been considered to be rather difficult to prevent the density unevenness in both solid and dot images simultaneously.

SUMMARY OF THE INVENTION

Therefore, an object of the present invention is to provide an image forming apparatus in which the solid and dot images are reproduced without density unevenness regardless of eccentricity of the rotating member such as photosensitive member and/or developing roller.

To achieve the object, the image forming apparatus comprises a pair of spacedly opposed first and second bearing members, in which a powder developer material is moved from the first bearing member to the second bearing member. The apparatus also includes an electric field generator which forms an electric field between the first and second bearing members. The generator outputting a first voltage and a second voltage alternately, the first voltage generating between the first and second bearing members a first electric field electrically forcing the developer material from the first bearing member toward the second bearing member and the second voltage generating between the first and second bearing members a second electric field electrically forcing the developer material from the second bearing member toward the first bearing member. Durations of the first and second voltages are determined so that the developer material forced out of the first bearing member due to the first electric field is forced back from the second bearing member toward the first bearing member due to the second electric field to impinge the developer material retained on the first bearing member and thereby flick the developer material on the first bearing member away therefrom and the flicked developer material is then forced from the first bearing member toward the second bearing member by the subsequent first electric field.

In another aspect of the invention, a first potential region and a second potential region are formed on the second bearing member, the first potential region having a first potential cooperating with the first and second voltages to electrically force the developer material from the first bearing member toward the second bearing member and the second potential region having a second potential cooperating with the first and second voltages to electrically forces the developer material from the second bearing member toward the first bearing member.

In another aspect of the invention, a voltage difference $V_{PP}$ (volt) between the first and second voltages, a voltage difference $V_{DC}$ (volt) of an average voltage of the first and second voltages relative to a ground, an average potential V (volt) of the first and second potentials, and a ratio ADR (%) of an output duration of the first voltage relative to a total output duration of the first and second voltages have a relationship represented by following equations:

$$ADR>(-0.033V_{PP}+0.097)|V|/1{,}000+$$

$$(0.039V_{PP}-0.110)|V_{DC}|+39.19-5, \text{ and}$$

$$ADR<(-0.033V_{PP}+0.097)|V|/1{,}000+$$

$$(0.039V_{PP}-0.110)|V_{DC}|+39.19+5.$$

According to any of the above-arranged image-forming apparatuses of the present invention, the developer material is efficiently supplied from the first bearing member to the second bearing member, so that images free from density unevenness are obtained.

BRIEF DESCRIPTION OF THE DRAWINGS

The present invention will become more fully understood from the detailed description and the accompanying drawings, wherein:

FIGS. 14A, 14B, and 14C are diagrams showing graphs each indicating experimental results for toner A in terms of the generation of density unevenness and the image density;

FIGS. 15A, 15B, and 15C are diagrams showing graphs each indicating experimental results for toner B in terms of the generation of density unevenness and the image density;

FIGS. 16A, 16B, and 16C are diagrams showing graphs each indicating experimental results for toner C in terms of the generation of density unevenness and the image density; and FIGS. 17A, 17B, and 17C are diagrams showing graphs each indicating experimental results for toner D in terms of the generation of density unevenness and the image density.

DETAILED DESCRIPTION OF THE PREFERRED EMBODIMENTS

The following descriptions of the preferred embodiments are merely exemplary in nature and are in no way intended to limit the invention, its application, or uses.

Image Forming Apparatus

Referring to the accompanying drawings, preferred embodiments of the present invention will be described below.

Figure 1:
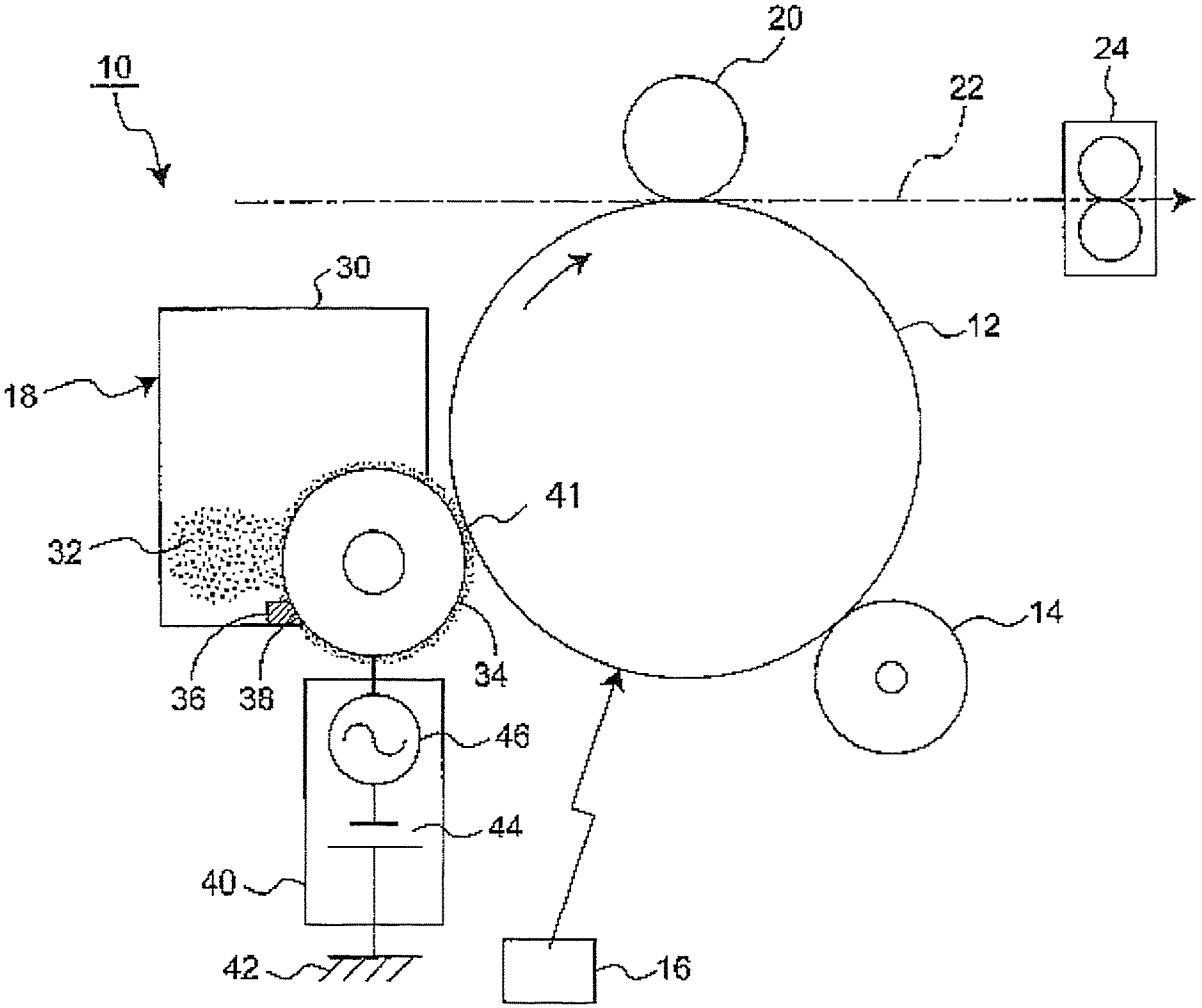
FIG. 1 is a schematic cross sectional view of an image forming apparatus according to an embodiment of the present invention.

First, referring to the FIG. 1, a brief discussion will be made to a structure and an operation of the image forming apparatus according to a first embodiment of the present invention. The image forming apparatus, generally indicated at 10, has a photosensitive member 12 which serves as an electrostatic latent image bearing member or developing material bearing member (the second bearing member). The present invention is not limited for use with the cylindrical photosensitive member and a belt type photosensitive member may be used instead. The photosensitive member 12 is drivingly connected to a drive source such as motor not shown so that it rotates in the clockwise direction as needed. An electric charger 14 is provided adjacent the peripheral surface of the photosensitive member 12 for imparting electric charge on the peripheral surface, in particular, an image forming region of the rotating photosensitive member 12. An image projector 16 is provided to project light onto the charged peripheral surface portion of the rotating photosensitive member 12 to form an electrostatic latent image. Typically, the electrostatic latent image has an image region (first potential region) in which the light is projected so that the electric charge or potential is reduced and a non-image region (second potential region) in which no light is projected so that the substantially the charged potential is maintained. In this embodiment, the image region corresponds to the visible image to be reproduced, so that the developing material of toner particles is supplied from a developing device 18. The visualized toner image is then transferred onto a recording medium 22 such as paper being transported between the photosensitive member 12 and a transfer device 20. The transferred toner image is transported with the recording medium 22 into a fusing device 24 where it is fused and fixed on the recording medium. The recording medium 22 with the fused toner image is discharged onto a catch tray not shown.

Developing Device

The developing device 18 has a housing 30 for accommodating a single component developer material or toner mainly made of toner particles and a developer bearing member (first bearing member) in the form of a developing roller 34 for supplying toner particles 32 onto the peripheral surface of the photosensitive member 12. A charging member 36 is provided in contact with the peripheral surface of the developing roller 34 so as to apply the toner particles 32 onto the peripheral surface of the developing roller 34 and also provide a certain electric charge to the applied toner particles 32. The developing roller 34 is electrically connected to an electric field generator having a power source 40. The power source 40 has DC power supply 44 and AC power supply 46, connected between the developing roller 34 and a ground 42.

According to the developing device 18 so constructed, the toner particles 32 in the housing 30 is retained on the peripheral surface of the developing roller 34 and then electrically charged at the contact region 38 of the charging member 36. An amount of toner particles on the respective peripheral surface portions of the developing roller 34 passed through the contact region 38 are regulated constant. The toner particles 32 passed through the contact region 38 are transported into the developing region 41 defined between the photosensitive member 12 and the developing roller 34, where the toner particles 32 are supplied onto the image region of the electrostatic latent image. The peripheral portions of the developing roller 34 are then rotated into the interior of the housing 30 where they are supplemented with toner particles, if needed.

Figure 2:
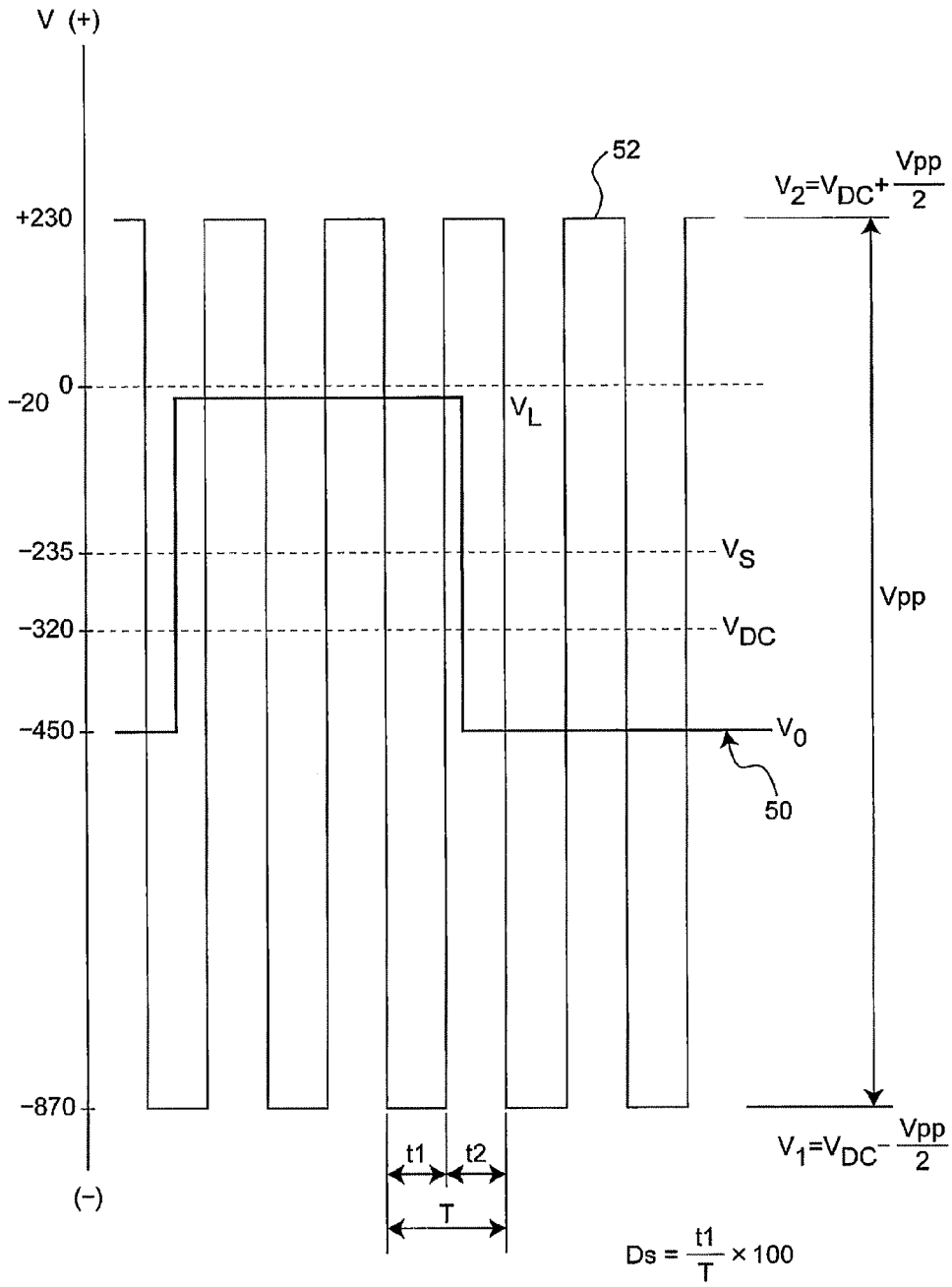
FIG. 2 is a diagram showing potentials on a photosensitive member and voltages applied to a developing roller.

Referring to FIG. 2, a developing operation at the developing region will be described. In this embodiment, it is assumed that the toner particle 32 is negatively charged. In this drawing, a solid line 50 indicates a potential of the electrostatic latent image on the photosensitive member 12, which includes the first potential region having voltage $V_L$ which is reduced by the projection of light and a second potential region having another voltage $V_0$ which is substantially the same as the originally charged voltage. A solid line 52 indicates a voltage of the developing roller 34. As described above, the developing roller 34 is connected to DC power supply 44 and AC power supply 46, so that a combination of the DC voltage from the DC voltage supply 44 and the AC voltage from the AC voltage supply 46 is applied to the developing roller 34. The DC voltage is indicated by $V_{DC}$. The AC voltage, which is in the form of rectangular wave, has a peak-to-peak voltage $V_{PP}$. Then, the resultant voltage of the DC and AC voltages changes like a rectangular-wave which changes alternately between a first voltage $V_1$ ($=|V_{DC}|-V_{PP}/2$) and a second voltage $V_2$ ($=V_{PP}/2-|V_{DC}|$). Assuming that the a duration of the first voltage $V_1$ is $t_1$ and a duration of the second voltage $V_2$ is $t_2$, a duty ratio of the first voltage $V_1$ is defined by $100t_1/(t_1+t_2)$, which is hereinafter referred to as "supply duty ratio".

Table 1 shows an example of voltage condition.

TABLE 1

| Voltage Condition | |
|---|---|
| | (volt) |
| $V_O$ | −450 |
| $V_L$ | −20 |
| $V_{PP}$ | 1100 |
| $V_{DC}$ | −320 |
| $V_1$ | −870 |
| $V_2$ | 230 |

Under the condition, in the developing region 41, the negatively charged toner particle 32 is subject to a supplying electric field which forces the charged toner particles from the developing roller 34 toward the photosensitive member 12 and a collecting electric field which forces the charged toner particles from the photosensitive member 12 back toward the developing roller 34, alternately. On average, the negatively charged toner particle 32 is forced to jump from the developing roller 34 toward the photosensitive member 12 due to the voltage difference between $V_{DC}$ of −320 volts and $V_L$ of −20 volts in the first potential region (image portion) of the electrostatic latent image. Since the second potential region (non-image portion) of the electrostatic latent image has voltage $V_0$ of −450 volts, the negatively charged toner particle is retained on the developing roller 34, without jumping from the developing roller 34 to the second voltage portion.

Amount to Jumping Toner Particles

Figure 3:
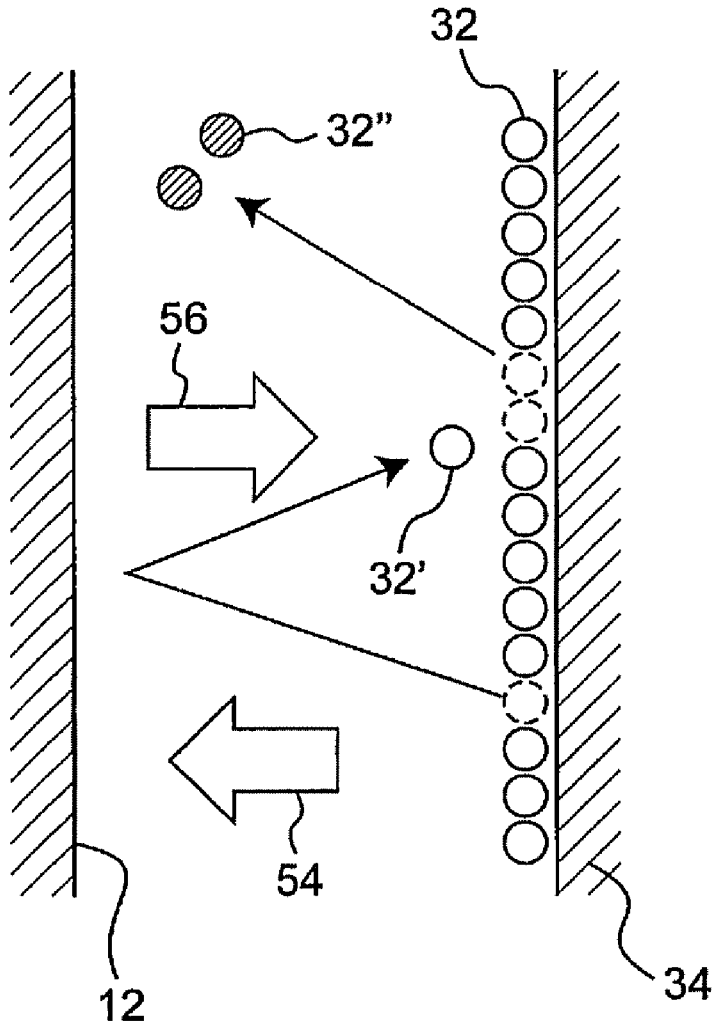
FIG. 3 is a diagram schematically showing movements of toner particles in a developing region.

An amount of toner particles jumping from the developing roller 34 to the photosensitive member 12 depends on the output of the AC power supply applied to the developing roller 34, in particular, voltages $V_1$, $V_2$, and the duty ratio $D_S$. Referring to FIG. 3, two electric fields are generated alternately between the developing roller 34 and the photosensitive member 12 due to the AC voltage applied therebetween; the first electric field (supplying electric field) which is caused by the voltage $V_1$ and electrically forces the toner particles from the developing roller 34 toward the photosensitive member 12 and the second electric field (collecting electric field) which is caused by the voltage V2 and electrically forces the toner particles back from the photosensitive member 12 toward the developing roller 34.

It is thought that the condition in which the first and second electric fields 54 and 56 act most effectively for the jumping of the toner particles 32 is that the toner particles 32' jumped out from the developing roller 34 toward the photosensitive member 12 by the first electric field 54 are attracted back from the photosensitive member 12 toward the developing roller 34 by the second electric field 56 to impinge the toner particles 32" retained on the developing roller 34, causing the toner particles 32" to be flicked away from the developing roller 34 and then forced by the first electric field 54 from the developing roller 34 toward the photosensitive member 12. This reciprocating action of the toner particles will be referred to as "pumping" hereinafter. Also, it is thought that, under the above-described optimal developing condition, images such as solid and dot images can be reproduced without causing any density unevenness regardless of any misalignment of the developing roller 34 relative to the photosensitive member 12, namely, any gap adjustment error between the photosensitive member 12 and the developing roller 34.

Optimal Developing Condition

Discussions will be made to the optimal developing condition. In the following discussions, it is assumed that the toner particle is negatively charged, and an average voltage of the image and non-image portions on the electrostatic latent image (hereinafter referred to as "voltage of the photosensitive member" and the DC voltage applied to the developing roller have a negative polarity.

Figure 4:
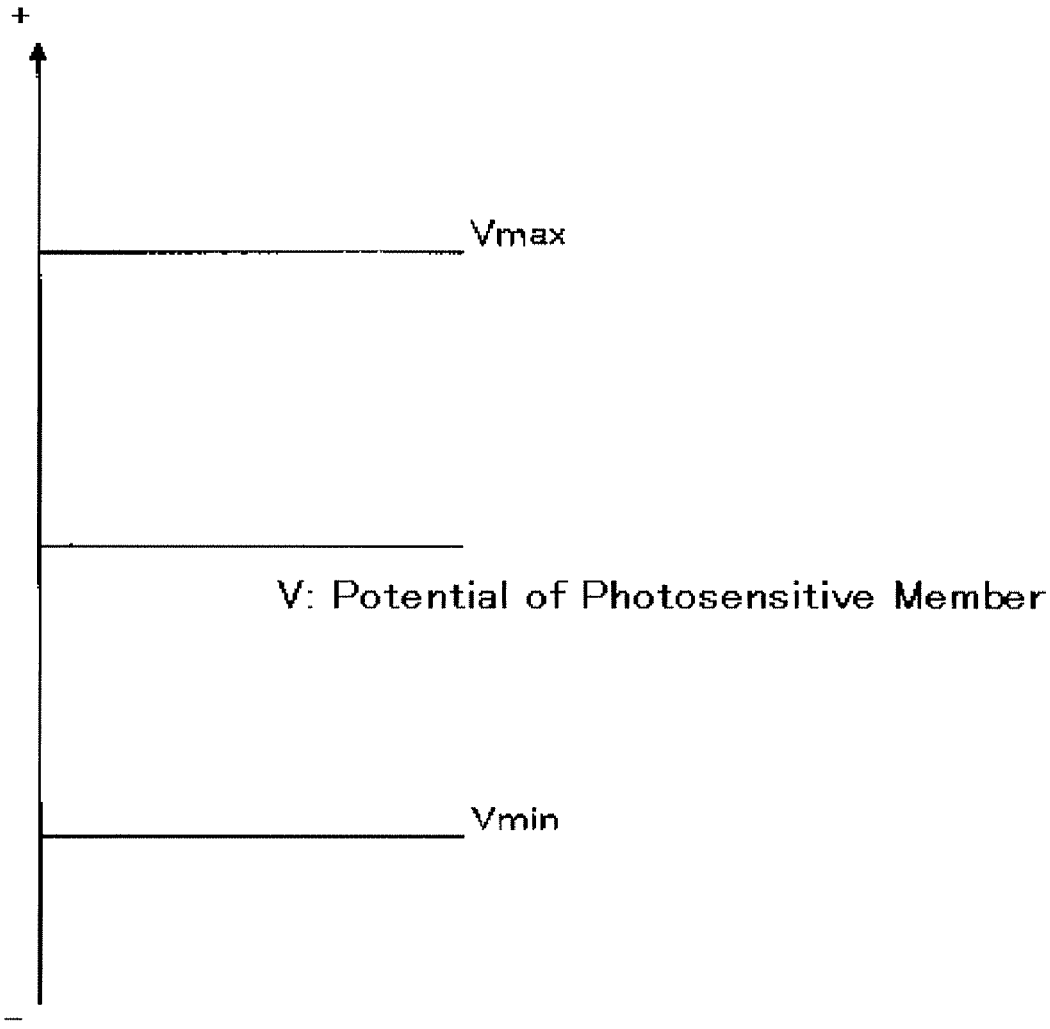
FIG. 4 is a diagram showing a relationship among potentials on the photosensitive member and the maximum and minimum values of a pulsating voltage.

FIG. 4 shows a relationship between the voltage of the photosensitive member and the pulsating voltage applied to the developing roller. It is assumed that the developing roller is applied with a combination of AC voltage having peak-to-peak voltage $V_{PP}$ and DC voltage $V_{DC}$. The maximum and minimum voltages $V_{max}$ and $M_{min}$ are represented by the following equations (3) and (4), respectively:

$$V_{max}=V_{PP}/2-|V_{DC}| \quad (3), \text{ and}$$

$$V_{min}=|V_{DC}|-V_{PP}/2 \quad (4).$$

Under the condition, a supplying acceleration $\alpha 1$ for the toner particle jumping from the developing roller toward the photosensitive member due to the supplying electric field, and a collecting acceleration ($\alpha 2$) for the toner particle jumping back from the photosensitive member toward the developing roller due to the collecting electric field are represented by the following equations (5) and (6), respectively:

$$\alpha 1=(q/m)(V-V_{min})/D \quad (5)$$

q: amount of electric charge on toner particle m: mass of toner particles

D: distance between the photosensitive member and the developing roller, and $$\alpha 2=(q/m)(V-V_{max})/D \quad (6)$$

An equation of motion which satisfies a condition that the toner particle jumped out from the developing roller toward the photosensitive member due to the supplying electric field moves back from photosensitive member toward the developing roller due to the subsequent collecting electric field to impinge the toner particles on the developing roller and, simultaneously with or immediately after the impingement, the subsequent supplying electric field act on the toner particles is represented by the following equation (7):

$$\alpha_1 \cdot t1^2/2+t1 \cdot t2+\alpha_2 \cdot t2^2/2=0 \quad (7)$$

wherein t1 is a time for toner particle to move from the developing roller to the photosensitive member, and t2 is a time for the toner particle to move from the photosensitive member to the developing roller.

The equation (7) can be substituted by the following equation (8):

$$(V-V_{min}) \cdot m^2+(V-V_{min}) \cdot m+(V-V_{max})=0 \quad (8)$$

wherein "m" indicates t1/t2.

An optimal pumping duty ratio (OPDR), i.e., $100t_2/t_1+t_2$), was calculated for the peak-to-peak voltage $V_{PP}$ and the DC voltage $V_{DC}$ indicated in the following Table 2 and the result is shown in the following Table 3.

TABLE 2

| Voltage Condition | |
|---|---|
| | (volt) |
| $V_{PP}$ | 1,700 |
| $V_{DC}$ | −520 |
| $V_{max}$ | 330 |
| $V_{min}$ | −1,370 |

TABLE 3

| Optimal Pumping Duty Ratio | | | | |
|---|---|---|---|---|
| V | $V-V_{min}$ | $V-V_{max}$ | t1/t2 | OPDR |
| 0 | 1370 | −330 | 0.201 | 16.7 |
| −50 | 1320 | −380 | 0.233 | 18.9 |
| −100 | 1270 | −430 | 0.267 | 21.1 |
| −150 | 1220 | −480 | 0.302 | 23.2 |
| −200 | 1170 | −530 | 0.338 | 25.3 |
| −250 | 1120 | −580 | 0.376 | 27.3 |
| −300 | 1070 | −630 | 0.416 | 29.4 |
| −350 | 1020 | −680 | 0.457 | 31.4 |
| −400 | 970 | −730 | 0.501 | 33.4 |
| −450 | 920 | −780 | 0.548 | 35.4 |
| −500 | 870 | −830 | 0.597 | 37.4 |

Next, the optimal pumping duty ration (OPDR) was calculated for each of the combinations of the peak-to-peak voltages $V_{PP}$ and the DC voltages $V_{DC}$. The result is shown in the following Table 4.

TABLE 4

| Optimal Pumping Duty Ratio (OPDR) | | | | | | | | | |
|---|---|---|---|---|---|---|---|---|---|
| | $V_{PP}$ (volt) | | | | | | | | |
| | 1300 | 1500 | 1700 | 1300 | 1500 | 1700 | 1300 | 1500 | 1700 |
| | $V_{DC}$ (volt) | | | | | | | | |
| | −520 | −520 | −520 | −420 | −420 | −420 | −320 | −320 | −320 |
| 0 | 9.2 | 13.5 | 16.7 | 15.4 | 18.7 | 21.1 | 21.2 | 23.5 | 25.3 |
| −50 | 12.3 | 16.1 | 18.9 | 18.3 | 21.1 | 23.2 | 23.9 | 25.9 | 27.3 |
| −100 | 15.4 | 18.7 | 21.1 | 21.2 | 23.5 | 25.3 | 26.6 | 28.2 | 29.4 |
| −150 | 18.3 | 21.1 | 23.2 | 23.9 | 25.9 | 27.3 | 29.3 | 30.5 | 31.4 |

TABLE 4-continued

| Optimal Pumping Duty Ratio (OPDR) | | | | | | | | | |
|---|---|---|---|---|---|---|---|---|---|
| | $V_{PP}$ (volt) | | | | | | | | |
| | 1300 | 1500 | 1700 | 1300 | 1500 | 1700 | 1300 | 1500 | 1700 |
| | $V_{DC}$ (volt) | | | | | | | | |
| | −520 | −520 | −520 | −420 | −420 | −420 | −320 | −320 | −320 |
| −200 | 21.2 | 23.5 | 25.3 | 26.6 | 28.2 | 29.4 | 31.9 | 32.7 | 33.4 |
| −250 | 23.9 | 25.9 | 27.3 | 29.3 | 30.5 | 31.4 | 34.5 | 35.0 | 35.4 |
| −300 | 26.6 | 28.2 | 29.4 | 31.9 | 32.7 | 33.4 | 37.1 | 37.3 | 37.4 |
| −350 | 29.3 | 30.5 | 31.4 | 34.5 | 35.0 | 35.4 | 39.8 | 39.6 | 39.4 |
| −400 | 31.9 | 32.7 | 33.4 | 37.1 | 37.3 | 37.4 | 42.4 | 41.9 | 41.4 |
| −450 | 34.5 | 35.0 | 35.4 | 39.8 | 39.6 | 39.4 | 45.1 | 44.2 | 43.5 |
| −500 | 37.1 | 37.3 | 37.4 | 42.4 | 41.9 | 41.4 | 47.9 | 46.6 | 45.6 |

Figure 5:
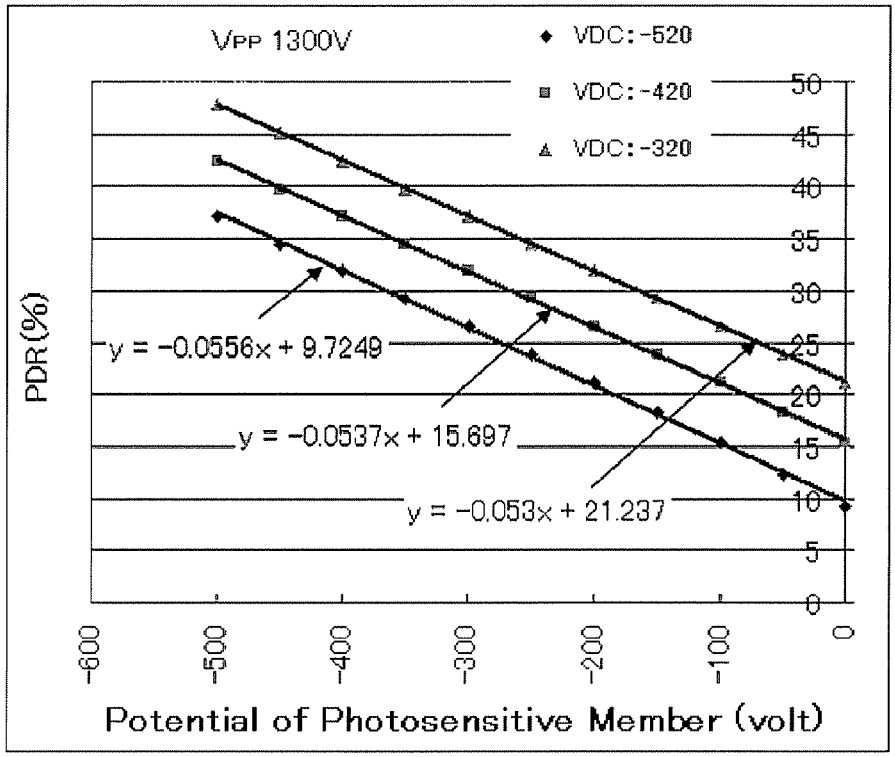
FIG. 5 is a graph showing a relationship between the potentials on the photosensitive member and the optimal pumping duty ration (OPDR) for a peak-to-peak voltage of 1,300 volts.
Figure 6:
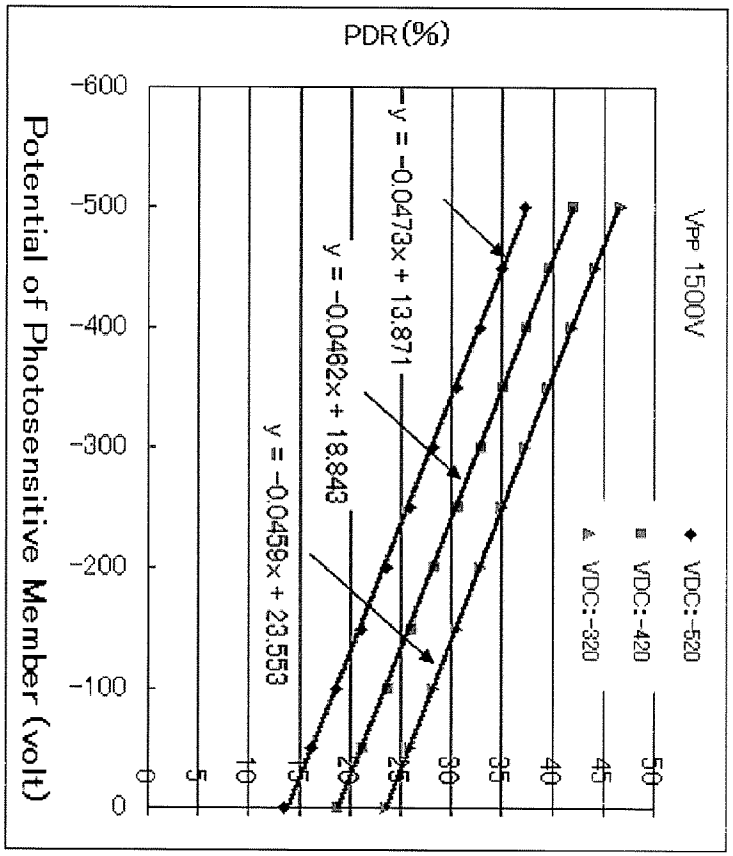
FIG. 6 is a graph showing a relationship between the potentials on the photosensitive member and the optimal pumping duty ration (OPDR) for a peak-to-peak voltage of 1,500 volts.
Figure 7:
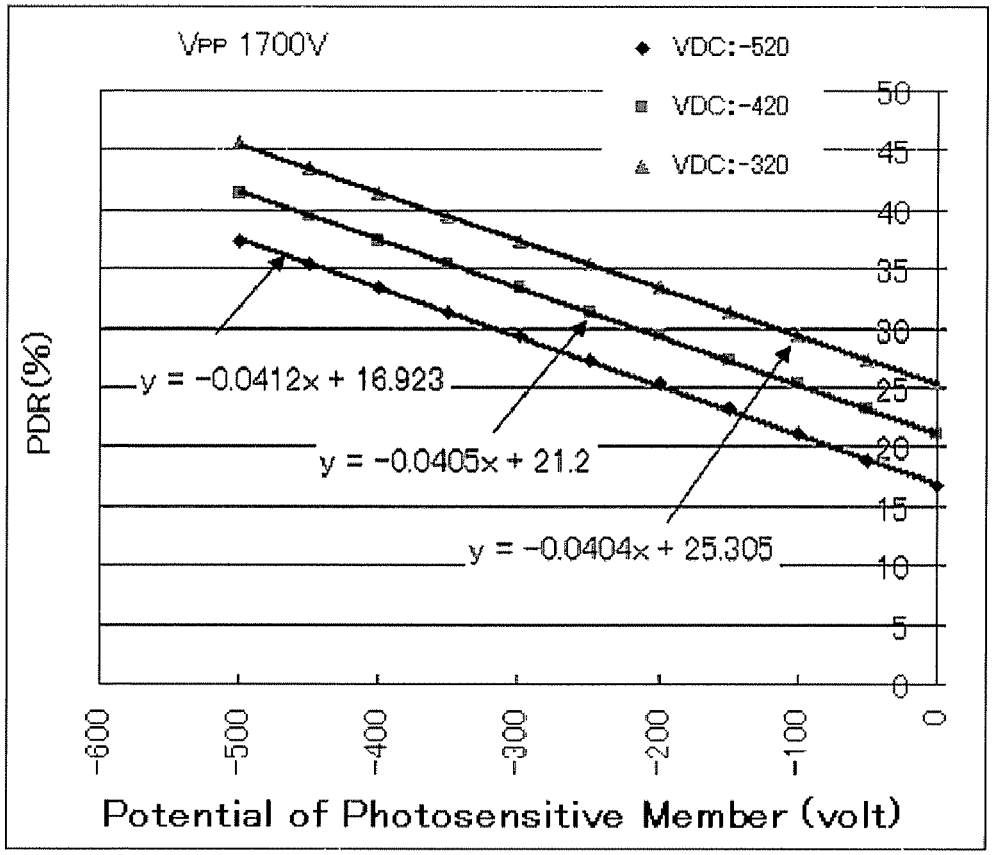
FIG. 7 is a graph showing a relationship between the potentials on the photosensitive member and the optimal pumping duty ration (OPDR) for a peak-to-peak voltage of 1,700 volts.

As shown in FIGS. 5-7, according to Table 4, OPDRs for each DC voltages (VDC: −320, −420, and −520 volts) were plotted in the graph indicating a relationship between the voltage of the photosensitive member and OPDR, for respective peak-to-peak voltages ($V_{PP}$: 1,300, 1,500, and 1,700 volts). Also, a liner function was fitted to the plotted points of each of DC voltages, which is represented in the following equations (9.1)-(9.9):

(a) $V_{PP}$: 1,300 V $$y=-0.0556x+9.7249 \quad (9.1);$$

$$y=-0.0537x+15.697 \quad (9.2);$$

$$y=-0.053x+21.237 \quad (9.3);$$

(b) $V_{PP}$: 1,500 V $$y=-0.0473x+13.871 \quad (9.4);$$

$$y=-0.0462x+18.843 \quad (9.5);$$

$$y=-0.0459x+23.553 \quad (9.6);$$

(c) $V_{PP}$: 1,700 V $$y=-0.0412x+16.923 \quad (9.7);$$

$$y=-0.0405x+21.200 \quad (9.8); \text{ and}$$

$$y=-0.0404x+25.305 \quad (9.9).$$

As is apparent from FIGS. 5 to 7, the optimal pumping duty ratio can be represented by the linear function of the voltage of the photosensitive member. The three fitted lines in each of the graphs have substantially the same slopes or linear coefficients. Also, the slopes of the fitting lines drawn in the three graphs are different from one another. This shows that the slope of the fitting line varies depending upon the peak-to-peak voltages $V_{PP}$. The values of the zero orders of the three fitting lines for the same DC voltage in each of the three graphs are different from one another.

As can be seen from above, since the linear coefficient of each fitting line depends upon the peak-to-peak voltage $V_{PP}$ and also the value of the zero order depends upon both of the peak-to-peak voltage $V_{PP}$ and the DC voltage $V_{DC}$, the optimal pumping duty ratio is defined by a linear function represented by the following equation (10):

$$OPDR=f_1(V_{PP}) \cdot V/1{,}000+f_2(V_{PP}, V_{DC}) \quad (10).$$

An average of the slopes of (first order coefficients $f_1(V_{PP})$) of three liner functions and the values ($V_{PP}$, $V_{DC}$) of the zero order, for each $V_{PP}$, are shown in the following Table 5:

TABLE 5

| Relationship between $f_1(V_{PP})$ and $f_2(V_{PP}, V_{DC})$ | | | | |
|---|---|---|---|---|
| $V_{PP}$ (kV) | $f_1(V_{PP})$ | $f_2(V_{PP}, V_{DC})$ | | |
| [volt] | [volt] | −320[volt] | −420[volt] | −520[volt] |
| 1,300 | −0.054 | 21.237 | 15.697 | 9.725 |
| 1,500 | −0.046 | 23.553 | 18.843 | 13.871 |
| 1,700 | −0.041 | 25.305 | 21.200 | 16.923 |

Figure 8:
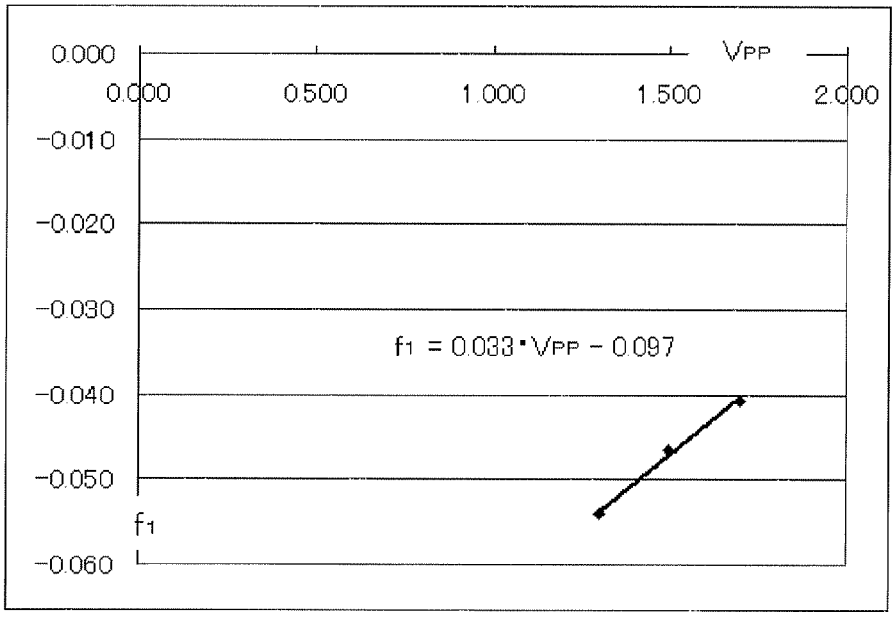
FIG. 8 is a graph for use in describing a fitting process through which the OPDR is obtained.

As shown in FIG. 8, the three values of the linear coefficients $f_1(V_{PP})$ in Table 5 were plotted on the graph indicating the relationship between the linear coefficient $f_1(V_{PP})$ and the peak-to-peak voltage $V_{PP}$, and these three points was fitted by a linear function. The fitted linear function is represented by the following equation (11):

$$f_1(V_{PP})=0.033\cdot V_{PP}-0.097 \quad (11).$$

The value $f_2(V_{PP}, V_{DC})$ of the zero order is defined by a linear function represented by the following equation (12):

$$f_2(V_{PP}, V_{DC})=f_3(V_{PP})\cdot V_{DC}+f_4 \quad (12).$$

Figure 9:
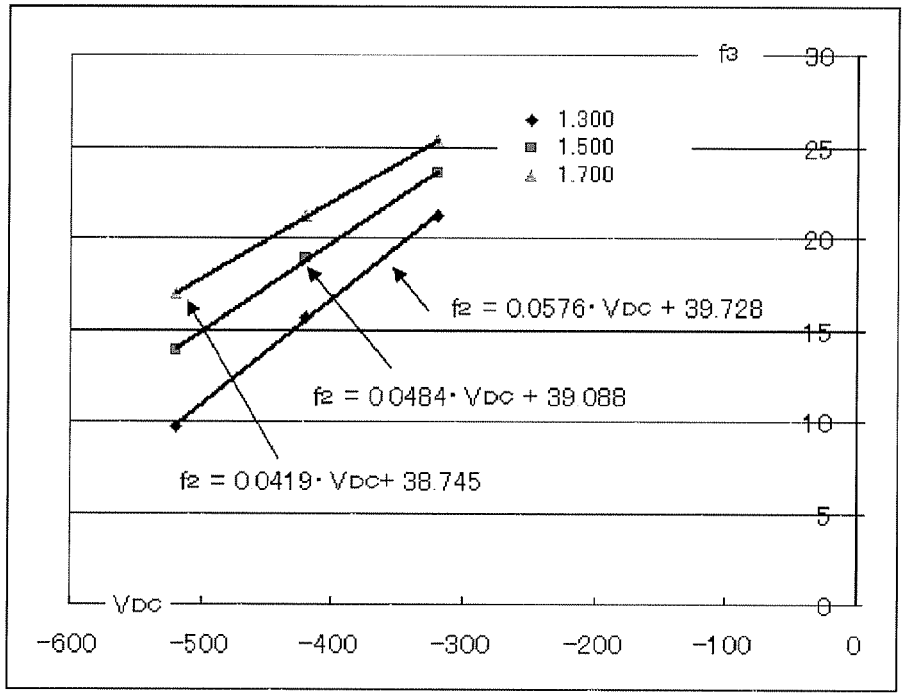
FIG. 9 is also a graph for use in describing a fitting process through which the OPDR is obtained.

As shown in FIG. 9, the values of $f_2(V_{PP}, V_{DC})$ for the respective values of $V_{PP}$ shown in Table 5 were plotted in the graph indicating the relationship between $f_2(V_{PP}, V_{DC})$ and the DC voltage $V_{DC}$, and the plotted points for the respective values of $V_{PP}$ were fitted by linear functions. The fitted linear functions are represented by the following equations (13):

$$f_2(V_{PP}, V_{DC})=0.0576V_{DC}+39.728 \quad (13.1)$$

$$f_2(V_{PP}, V_{DC})=0.0484V_{DC}+39.088 \quad (13.2), \text{ and}$$

$$f_2(V_{PP}, V_{DC})=0.0419V_{DC}+38.745 \quad (13.3).$$

Using the average value (=39.19) of the coefficients of the zero orders for the three linear functions, $f_2(V_{PP}, V_{DC})$ is represented by the following equation (14):

$$f_2(V_{DC})=f_3(V_{PP})\cdot V_{DC}+39.19 \quad (14).$$

Figure 10:
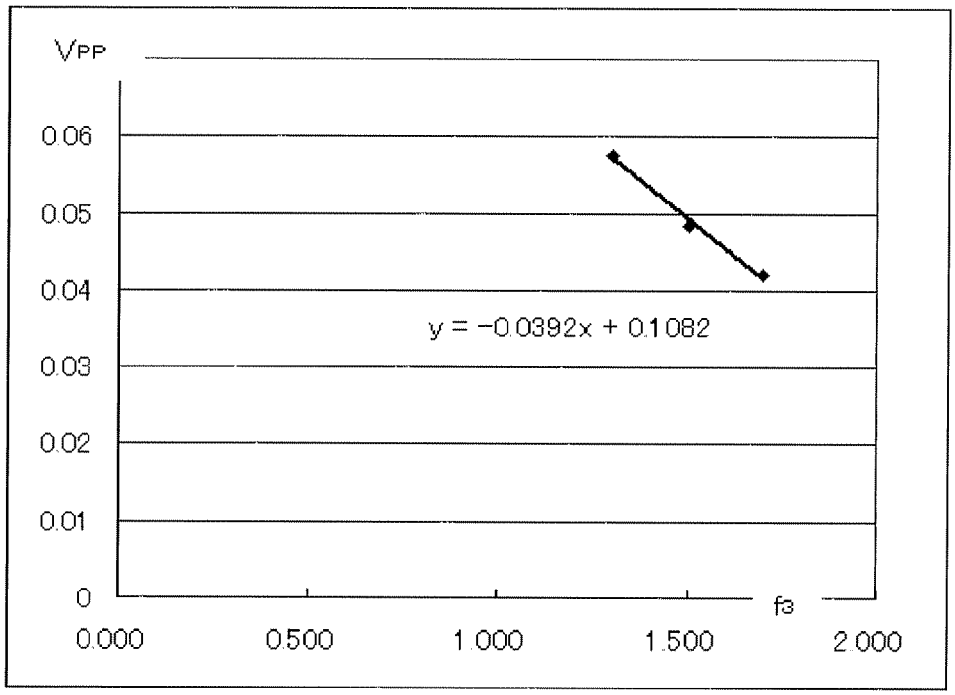
FIG. 10 is also a graph for use in describing a fitting process through which the OPDR is obtained.

As shown in FIG. 10, the values of $f_2(V_{PP}, V_{DC})$ were plotted in the graph showing the relationship between $f_2(V_{PP}, V_{DC})$ and the DC voltage $V_{DC}$, and the respective plotted points were fitted by a linear function. The fitted linear function is represented by the following equation (15):

$$f_3(V_{PP})=-0.0392V_{PP}+0.1082 \quad (15).$$

From equations (10), (11), (14) and (15), an optimal pumping duty ratio OPDR is represented by the following equation (16):

$$OPDR=(0.033V_{PP}-0.097)V/1{,}000+(-0.039V_{PP}-0.110)V_{DC}+39.19 \quad (16).$$

The above-described calculation was made on condition that potential V of the photosensitive member, the DC voltage $V_{DC}$, and the toner particle have negative polarity, however, they may have a different polarity. Considering the above two conditions, the equation (16) is rewritten in the following general equation (17):

$$OPDR = (-0.033V_{PP}+0.097)|V|/1{,}000+(0.039V_{PP}-0.110)|V_{DC}|+39.19. \quad (17)$$

Equation of Motion

A process in which equation (7) is derived will be described below. When a particle is moved from an initial position $X_0$ at an initial speed $V_0$ and at an acceleration $\alpha$, a position X(t) and a speed V(t) of this particle after time (t) are obtained by the following equations (18) and (19), respectively:

$$X(t)=X_O+V_O\cdot t+(1/2)\cdot\alpha t^2 \quad (18), \text{ and}$$

$$V(t)=X_O+\alpha\cdot t \quad (19).$$

Assume that a toner particle is placed still on the surface of the developing roller at t=0, and that this toner particle is exposed to an action of a supplying electric field by which an accelerational is obtained, for time t1. In this instance, the position $X_1$ and the speed $V_1$ of the toner particle after the completion of application of the supplying electric field are determined by the following equations (20) and (21):

$$X_1=(1/2)\alpha 1\cdot t1^2 \quad (20), \text{ and}$$

$$V_1=\alpha 1\cdot t1 \quad (21).$$

After the completion of application of the supplying electric field, the toner particle is exposed to an action of a collecting electric field by which an acceleration $\alpha$2 is obtained, for a time of t2. In this case, the position $X_2$ of the toner particle found after the completion of application of the collecting electric field is determined by the following equation (22):

$$X_2=X_1+V_1\cdot t2+(1/2)\alpha 2\cdot t2^2 \quad (22).$$

When $X_1$ of the equation 20 and the speed $V_1$ of the equation 21 are substituted for those of this equation (22), the following equation (23) is obtained $$X_2=(1/2)\alpha 1\cdot t1^2+\alpha 1\cdot t1^2+(1/2)\alpha 2\cdot t2^2 \quad (23).$$

In this way, the position of the toner particle exposed to the actions of the supplying electric field and the collecting electric field is determined by equation (23). In this equation (23), the condition that $X_2$ of the left side is "0" (zero) (the condition shown in the equation (17)) is a condition to obtain the above-described optimal pumping of toner particles in which the toner particle jumped out of the developing roller toward the photosensitive member by the supplying electric field is then returned back toward the developing roller by the collecting electric field to impinge the surface of the developing roller when the application of the collecting electric field has just been completed, and the subsequent supplying electric field acts on the toner particle simultaneously with or immediately after the impingement of the toner particle.

Verification of Optimal Developing Condition

The image formations were made under different conditions to verify the theoretical developing condition provided by the equation (17). Specifically, for different toner particles, it was verified whether the toner particles could readily be moved from the developing roller due to the pumping action. The matters necessary for the verification are described below.

1. Mechanical Adhesion of Toner Particles

The Development is performed by using a phenomenon in which the charged toner particle retained on the developing roller is electrically attracted by the developing roller. Then, in order to evaluate the developing property of the toner particle, it is necessary to know the mechanical adhesion force of the toner particle to the photosensitive member.

Figure 11:
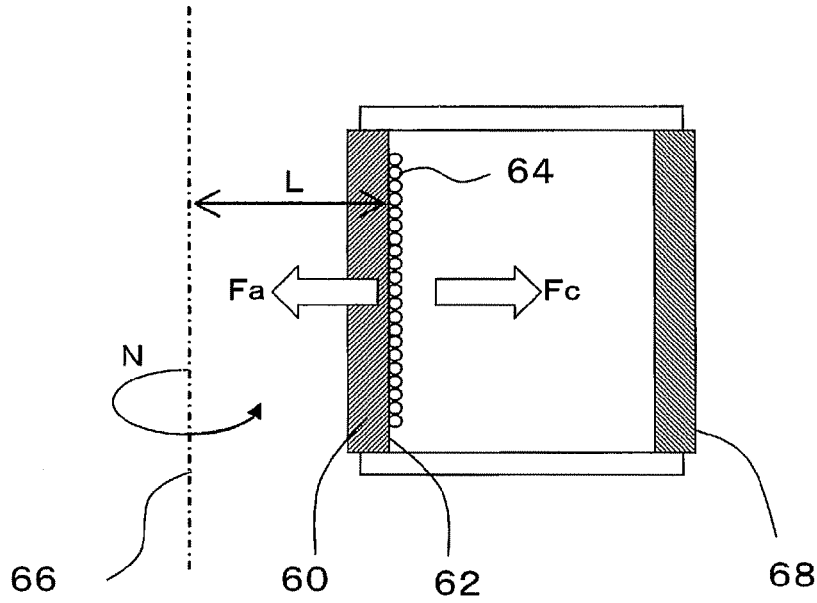
FIG. 11 is a graph for use in describing a centrifugal separation method.

The adhesion force of the toner particle to the developing roller was determined through a centrifugal separation method. Referring to FIG. 11, the centrifugal separation method will be described. As shown in the drawing, a substrate 60 serving as a developing roller was prepared. A layer formed of the same material as the surface layer of a developing roller was provided on the surface 62 of the substrate 60. Different toners 64 with different average particle diameters and different degrees of circularity were prepared, including toners A and B with circularity degree of 0.96 and average particle diameters of 12 μm and 8 μm, respectively, and toners C and D with circularity degrees 0.96 and 0.90, respectively, and average particle diameters of 8 μm. The toner particles 64 having no electric charge were dispersed on the surface 62 of the substrate to retain thereon due to the mechanical adhesion force of the toner particles 64 to the surface 62 of the substrate. A centrifugal separator (not shown) was used to rotate the substrate 60 centering on the rotation axis 66 of the centrifugal separator to thereby apply a centrifugal force Fc to the toner particles 64, causing the toner particles 64 to be separated from the substrate 60 and then be captured by a capturing member 68 located outside the substrate 60 in the radial direction thereof. Then, a relationship between each average particle diameter and the centrifugal force Fc and a relationship between each circularity degree and the adhesion force Fa were determined.

The centrifugal force applied to the toner particles was calculated from the following equation (24):

$$Fc=(4\pi/3)(d/2)^3\cdot\rho\cdot L\cdot(2\pi N/60)^2 \quad (24),$$

wherein

| | |
|---|---|
| Fc: | centrifugal force, |
| d: | particle diameter, |
| ρ: | specific gravity, |
| L: | distance from rotation axis to particle, and |
| N: | the number of rotations. |

Here, the particle diameter d, the specific gravity ρ and the distance L were already known. The number of rotations N was the number of rotations at which the toner particles separated from the substrate 60. Then, using the number of rotations N, the centrifugal force Fc acting on the toner particles at this number of rotations, i.e., toner adhesion force Fa, was calculated from the equation (24).

Figure 12A:
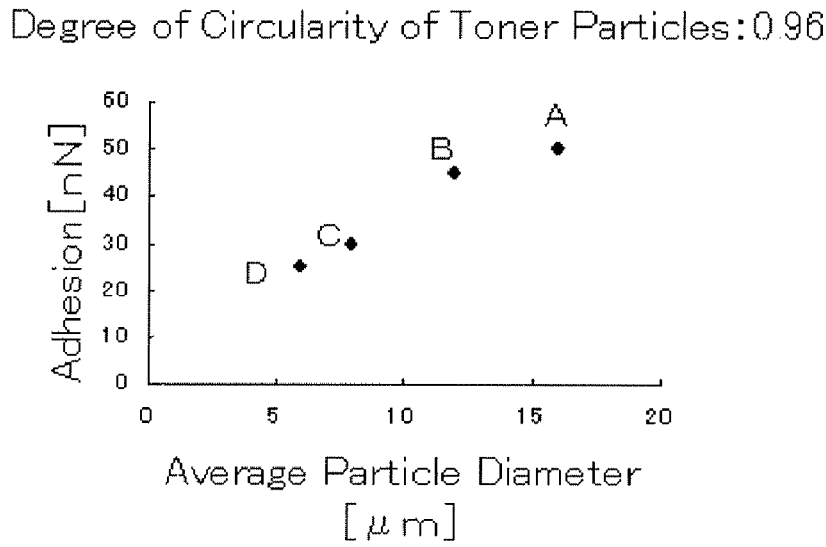
FIG. 12A is a graph showing a relationship between an average particle diameter of toner and an adhesion force thereof.
Figure 12B:
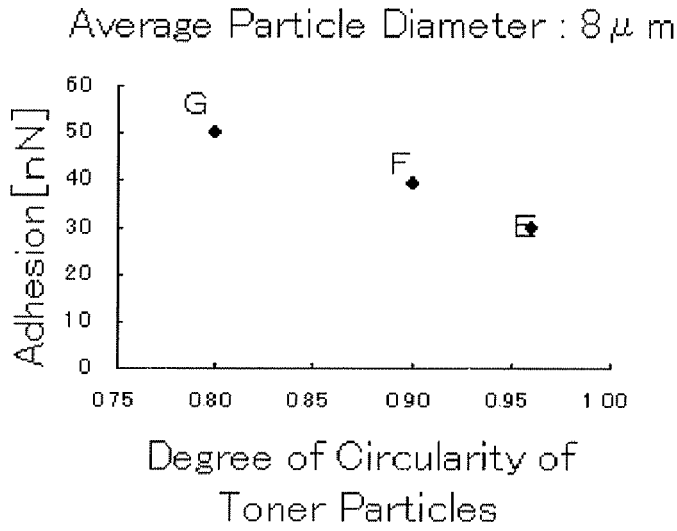
FIG. 12B is a graph showing a relationship between a degree of circularity of the toner and an adhesion force thereof.

As a result of the calculation, the adhesion forces of the toners A and B were determined as 45 nN and 30 nN, respectively, as shown in FIG. 12(*a*). Also, the adhesion forces of the toners C and D were determined as 39 nN and 30 nN, respectively, as shown in FIG. 12(*b*). The drawings show that the adhesion force of the toner increases in proportion to the toner particle diameter or in inverse proportion to the degree of circularity.

2. Electrostatic Latent Image

Figure 13A:
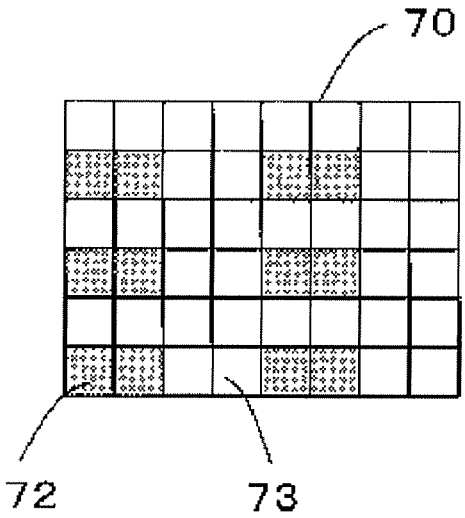
FIG. 13A is a diagram for use in describing a dot electrostatic latent image.
Figure 13B:
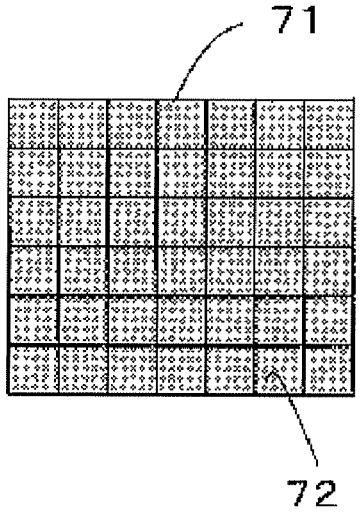
FIG. 13B is a diagram for use in describing a solid electrostatic latent image.

Two electrostatic latent images, a halftone latent image 70 and a solid latent image 71 shown in FIGS. 13A and 13B, respectively, were prepared. In the drawings, shaded segments or pixels 72 are the electrostatic latent image portions on which toner particles are attracted and blank segments or pixels 73 are the electrostatic latent image portions on which toner particles are not attracted.

3. Voltage Conditions

The alternating voltage $V_{PP}$ was set within a range of 1,500 to 1,800 volts. The supply duty ratio was set within a range of 10 to 50%. The frequency of the alternating voltage was set to 2,000 Hz. Other voltage conditions are indicated in Table 6.

TABLE 6

Voltage Conditions

| | [volt] |
|---|---|
| $V_O$ | −450 |
| $V_L$ | −20 |
| $V_{DC}$ | −320 |

4. Criteria for Evaluation

Density unevenness was visually evaluated for halftone and solid images obtained by developing the halftone and solid electrostatic latent images, respectively.

5. Theoretical Calculation

Theoretical developing conditions obtained from the conditions in Table 6 and equation (17) are shown in Table 7.

TABLE 7

Theoretical Developing Conditions

| Alternating voltage (V) | Supply Duty Ratio |
|---|---|
| 1,800 | 35.3 |
| 1,700 | 34.8 |
| 1,600 | 34.3 |
| 1,500 | 33.9 |

6. Result of Experiments

The result of evaluations of density unevenness in the halftone images and the solid images obtained by the developments using toners A to D under the respective voltage conditions is shown in Tables of FIGS. 14A-17C. In each Table, mark "Y" indicates that there was no density unevenness. FIGS. 14A, 15A, 16A, and 17A show the results of evaluations for the developed halftone images, FIGS. 14A, 15B, 16B, and 17B for the developed solid images, and FIGS. 14C, 15C, 16C, and 17C for halftone and solid images. As can be seen from the Tables, it was verified that the developing conditions determined by the equation (17) ensure to obtain clear images regardless of the amount of toner particles on the developing roller.

7. Proper Voltage Conditions

The equation (17) indicates the most suitable developing condition. The substantially the same results can be obtained within a range around the most suitable condition derived from equation (17). To determine the range, the following experiments were conducted.

In the experiments, it was confirmed whether halftone and solid images could be reproduced without any density unevenness and with a proper image density from 0.9 to 1.1, within a range obtained by changing the optimal pumping duty ratio by +5%. The potential V of the photosensitive member and the DC voltage were set 235 volts and 320 volts, respectively. The peak-to-peak voltage $V_{PP}$ was set within a range of 1,200 to 1,800 volts, as shown in the following Table 7. The resultant images were visually inspected whether the reproduced halftone and solid images had density unevenness. Also, the densities of the reproduced images were measured by a densitomenter. The results are shown in Table 8, in which the mark "Y" means that both the halftone and solid images had no density unevenness and also those images have proper image densities.

TABLE 8

Proper Duty Ratio

| $V_{PP}$(volt) | OPDR (%) | OPDR − 5(%) | OPDR + 5(%) |
|---|---|---|---|
| 1,800 | 35 | Y | Y |
| 1,700 | 35 | Y | Y |
| 1,600 | 34 | Y | Y |
| 1,500 | 34 | Y | Y |
| 1,400 | 33 | Y | Y |
| 1,300 | 33 | Y | Y |
| 1,200 | 32 | Y | Y |

In view of the foregoing, an appropriate duty ratio (ADR) can be determined to cover the range of +5% based on the optimal pumping duty ratio (OPDR), in which halftone and solid images are reproduced with no density unevenness. Accordingly, the appropriate duty ratio (ADR) is represented by the following equations (25) and (26):

$$ADR>(-0.033V_{PP}+0.097)|V|/1,000+(0.039V_{PP}-0.110)|V_{DC}|+39.19-5 \quad (25), \text{ and}$$

$$ADR<(-0.033V_{PP}+0.097)|V|/1,000+(0.039V_{PP}-0.110)|V_{DC}|+39.19+5 \quad (26).$$

As described above, the optimal and appropriate conditions are satisfied under the voltage conditions indicated by the equations (23) and (24), in which both halftone and solid images are reproduced without any density unevenness.

The discussions have been made to the voltage conditions between the first and second developer bearing members, i.e., the developing roller and the photosensitive member, however, the voltage conditions can be effectively applied to any of paired members between which the developer material is supplied from one member to the other.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An image forming apparatus comprising a pair of spacedly opposed first and second bearing members, in which a powder developer material is moved from the first bearing member to the second bearing member; comprising an electric field generator which forms an electric field between the first and second bearing members;

the generator outputting a first voltage and a second voltage alternately, the first voltage generating between the first and second bearing members a first electric field electrically forcing the developer material from the first bearing member toward the second bearing member and the second voltage generating between the first and second bearing members a second electric field electrically forcing the developer material from the second bearing member toward the first bearing member;

durations of the first and second voltages being determined so that the developer material forced out of the first bearing member due to the first electric field is forced back from the second bearing member toward the first bearing member due to the second electric field to impinge the developer material retained on the first bearing member and thereby flick the developer material on the first bearing member away therefrom and the flicked developer material is then forced from the first bearing member toward the second bearing member by the subsequent first electric field, wherein a first potential region and a second potential region are formed on the second bearing member, the first potential region having a first potential cooperating with the first and second voltages to electrically force the developer material from the first bearing member toward the second bearing member and the second potential region having a second potential cooperating with the first and second voltages to electrically force the developer material from the second bearing member toward the first bearing member, wherein a voltage difference $V_{pp}$ (volt) between the first and second voltages, a voltage difference $V_{DC}$ (volt) of an average voltage of the first and second voltages relative to a ground, an average potential V (volt) of the first and second potentials, and a ratio ADR (%) of an output duration of the first voltage relative to a total output duration of the first and second voltages have a relationship represented by following equations:

$$ADR>(-0.033V_{PP}+0.097)|V|/1,000+(0.039V_{PP}-0.110)|V_{DC}|+39.19-5, \text{ and}$$

$$ADR<(-0.033V_{PP}+0.097)|V|/1,000+(0.039V_{PP}-0.110)|V_{DC}|+39.19+5.$$

* * * * *